US008567929B1

(12) United States Patent
Turgeman

(10) Patent No.: US 8,567,929 B1
(45) **Date of Patent: *Oct. 29, 2013**

(54) WIDE FORMAT PRINTER CARTRIDGE REFILLING METHOD AND APPARATUS

(71) Applicant: Shahar Turgeman, Boca Raton, FL (US)

(72) Inventor: Shahar Turgeman, Boca Raton, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/851,067

(22) Filed: Mar. 26, 2013

Related U.S. Application Data

(63) Continuation of application No. 12/753,448, filed on Apr. 2, 2010, now Pat. No. 8,403,466.

(51) Int. Cl.
*B41J 2/175* (2006.01)

(52) U.S. Cl.
USPC ..... 347/85

(58) Field of Classification Search
USPC ..... 347/5, 7, 84, 85, 86; 141/2, 18, 95
See application file for complete search history.

(56) References Cited

U.S. PATENT DOCUMENTS 4,907,013 A 3/1990 Hubbard et al.
5,164,747 A 11/1992 Osada et al.
5,663,754 A 9/1997 Lorenze, Jr. et al.
5,835,108 A 11/1998 Beauchamp et al.
6,056,386 A 5/2000 Nohata et al.
6,058,984 A 5/2000 Sato
6,106,094 A 8/2000 Otani et al.
6,158,837 A 12/2000 Hilton et al.
6,199,977 B1 3/2001 Komplin et al.
6,215,557 B1 4/2001 Owens
6,261,353 B1 7/2001 Doi et al.
6,273,151 B1 8/2001 Kong
6,289,654 B1 * 9/2001 Yamaguchi et al. ..... 53/434
6,315,383 B1 11/2001 Sarmast et al.
6,331,038 B1 12/2001 Boleda et al.
6,332,481 B1 * 12/2001 Shinada et al. ..... 141/18
6,352,331 B1 3/2002 Armijo et al.
6,361,138 B1 3/2002 Seino et al.
6,539,985 B2 4/2003 Shinada et al.
6,568,786 B2 5/2003 Sarmast et al.
6,585,007 B2 7/2003 Kubokawa
6,616,260 B2 9/2003 Skene et al.
6,623,096 B1 9/2003 Castano et al.
6,637,853 B1 10/2003 Ahne et al.
6,644,772 B2 11/2003 Choi
6,679,577 B2 1/2004 Du et al.
6,705,694 B1 3/2004 Barbour et al.
6,729,360 B2 5/2004 Sesek et al.

(Continued)

*Primary Examiner* — Anh T. N. Vo
(74) *Attorney, Agent, or Firm* — Allen D. Hertz, P.A.; Allen D. Hertz

(57) ABSTRACT

The present invention provides a semi-automated and automated system for refilling wide format printer ink cartridges. The system includes a computer with memory provided to store information relating to a plurality of ink cartridges, and a user interface in signal communication with the computer and a database comprising respective fill information for a plurality of ink cartridge model numbers. The system comprises a series of ink reservoirs, a fill pump in fluid communication with the ink reservoir and an extraction pump. The system utilizes workstation needles comprising a blunt tip and an ink discharge aperture located along a sidewall proximate a transition between the sidewall and the blunt tip. A control valve can be provided between the fill pump, the extraction pump, and the workstation needle. A second, vent needle can be inserted into a vent port for a dual port cartridge form factor.

18 Claims, 8 Drawing Sheets

(56) References Cited

U.S. PATENT DOCUMENTS

| | | | | |
|---|---|---|---|---|
| 6,764,155 | B2 | 7/2004 | D'Souza et al. | |
| 6,799,842 | B2 * | 10/2004 | Barinaga et al. | 347/85 |
| 6,973,943 | B2 * | 12/2005 | Sesek et al. | 141/18 |
| 7,089,973 | B2 | 8/2006 | Nicodem et al. | |
| 7,172,272 | B2 | 2/2007 | Tsuchiya et al. | |
| 7,207,667 | B2 | 4/2007 | Ansier et al. | |
| 7,344,215 | B2 | 3/2008 | Cutler et al. | |
| 7,540,597 | B2 | 6/2009 | Guhse et al. | |
| 7,780,276 | B2 | 8/2010 | Guhse et al. | |
| 8,096,630 | B2 * | 1/2012 | Turgeman | 347/7 |
| 2001/0019343 | A1 | 9/2001 | Walker et al. | |
| 2002/0149641 | A1 | 10/2002 | Du et al. | |
| 2002/0175965 | A1 | 11/2002 | Skene et al. | |
| 2003/0081062 | A1 | 5/2003 | Kim et al. | |
| 2003/0146951 | A1 | 8/2003 | Skene et al. | |
| 2004/0046811 | A1 | 3/2004 | D'Souza et al. | |
| 2004/0263588 | A1 | 12/2004 | Ansier et al. | |
| 2004/0263589 | A1 | 12/2004 | Ansier et al. | |
| 2005/0018006 | A1 | 1/2005 | Im et al. | |
| 2005/0034777 | A1 | 2/2005 | Nicodem et al. | |
| 2005/0088495 | A1 | 4/2005 | Chan | |
| 2005/0099447 | A1 | 5/2005 | Hsu et al. | |
| 2006/0109320 | A1 | 5/2006 | Cutler et al. | |
| 2007/0051421 | A1 | 3/2007 | Sarnoff et al. | |
| 2007/0052740 | A1 | 3/2007 | Guhse et al. | |
| 2007/0052748 | A1 | 3/2007 | Sarnoff et al. | |
| 2007/0052770 | A1 | 3/2007 | Guhse et al. | |
| 2007/0052776 | A1 | 3/2007 | Guhse et al. | |
| 2007/0052777 | A1 | 3/2007 | Guhse et al. | |

* cited by examiner

WIDE FORMAT PRINTER CARTRIDGE REFILLING METHOD AND APPARATUS

CROSS-REFERENCE TO RELATED APPLICATION

This Continued Prosecution Patent Application claims the benefit of co-pending U.S. Non-Provisional patent application Ser. No. 12/753,448, filed on Apr. 2, 2010 (Issuing as U.S. Pat. No. 8,403,466 on Mar. 26, 2013), which is incorporated herein by reference in its entirety.

FIELD OF THE INVENTION

The present invention relates to the field of refilling spent ink cartridges. In particular, the present invention relates to a semi-automated and an automated system and method for refilling wide format ink cartridges for wide format printers.

BACKGROUND OF THE INVENTION

Ink jet printers are a popular form of printer used with computers and similar applications involving document printing or graphics preparation. Typical ink jet printers, such as those manufactured by Original Equipment Manufacturers (OEMs) such as Hewlett Packard, have replaceable ink jet cartridges with built-in print heads. While such OEM ink jet cartridges are a convenient manner of supplying ink to such printers, the cartridges are necessarily expensive due to their complexity and the provision of print heads with the cartridges.

Cartridges provided by printer manufacturers are typically not designed to be refilled when the ink supply runs out. It is well known, however, that such cartridges and their associated print heads have useful lives significantly longer than that provided by the initial supply of ink. Therefore, an aftermarket industry has evolved, that is directed to providing systems for refilling cartridges with ink. The need to provide ink refilling is especially acute in the case of color ink cartridges, because typically one color will run out of ink before the other colors are depleted.

Refilling ink cartridges with ink is not an easy task. First, some means must be provided to supply the ink to the interior of the cartridges. Because the ink reservoirs are typically filled with foam sponge, the ink refilling process is slow due to slow absorption of ink by the foam. Users typically do not have the patience to refill slowly (typically by squeezing a refill reservoir or by gravity feed), and this causes ink to flow into the foam sponge at a rate that is usually too fast to be absorbed. Ink accumulates in the bottom of the cartridge and overflows from the top and from the print head.

Wide format ink cartridges store significantly larger volumes of ink. Standard ink jet cartridges are refilled through holes that either pre-exist or are drilled through the housing. The needles comprise hollow tubes with open discharge ends for filling the cartridge. The ink is dispensed downward. The reservoir is formed of hard plastic. Contrarily, the wide format ink cartridges comprise a reservoir bag of Mylar, nylon, or like flexible material, contained within and protected by a plastic housing. The ink is transferred from the cartridge to a remote print head through a rubber (or similar material) seal. The combination of the soft-sided reservoir and rubber seal complicates the filling process. The soft-sided reservoir also has a tendency to entrap air. The entrapped air is discharged as air bubbles, which eventually work their way through the printing system and eventually block a portion of the print head. Foam in the foam sponge cartridges has a tendency to attract and contain the air bubbles, thus significantly reducing the problem in foam sponge cartridges. Therefore, it is critical to ensure that air is evacuated from the soft-sided reservoir and this dictates a different ink fill process.

To help speed the process, some refilling mechanisms of the prior art pressurize the ink while refilling the cartridge. See, e.g., U.S. Pat. No. 6,945,640 to Cheok, incorporated by reference herein. Such pressurization merely exacerbates an air injection problem, by inducting air along with the ink refilling the cartridge, and by preventing the removal of air from the foam sponge. The air injected into the foam sponge reservoir during refilling causes vapor lock in the ink reservoir. Ink then cannot reach the print head, and the printer fails. In order to overcome this problem, Cheok teaches that the air must subsequently be removed through vacuum evacuation of the cartridge. However, Cheok does not teach how much ink to add to the cartridge.

Prior art refilling mechanisms may not inject the proper quantity of ink into the reservoir. Such overfilling may bind the internal cartridge ink pump, create a mess from weeping ink, and may prevent the cartridge from functioning properly.

In order to avoid vapor lock, U.S. Pat. No. 4,967,207 to Ruder teaches completely evacuating the cartridge, and then supplying ink to refill the cartridge. In essence, Ruder improperly teaches that the vacuum within the cartridge will suck the proper amount of ink back into it. However, it is impossible to achieve a perfect vacuum. If the cartridge could structurally withstand a near perfect vacuum without being damaged, in Ruder's process, the cartridge would be completely filled with ink, and thus would be overfilled. A less than perfect vacuum will not fill the cartridge completely. A properly filled cartridge has a precise quantity of ink, and a certain amount of airspace. Therefore, Ruder does not solve the ink quantity problem.

U.S. Pat. No. 4,968,998 to Allen discloses refilling the cartridge while evacuating, such that the evacuation rate exceeds the filling rate. This Patent states that the cartridge can never be overfilled; however, if the air were completely removed from the cartridge, which would eventually happen by Allen's method, the airspace in the cartridge would no longer exist.

U.S. Pat. No. 5,903,292 to Scheffelin, et al. teaches refilling a spring-loaded collapsible ink bag, which maintains a negative pressure to draw ink into the bag until it is substantially full. However, many commercially available print cartridges are not constructed with such spring-loaded bags.

Another prior art solution to these refilling problems is a "Clip-In" type refill system. The original ink cartridge is modified by removing all of the original ink reservoirs, such that only the print heads and the case are left. Removable ink reservoirs are supplied, so the user only has to change the ink reservoir assembly causing no mess. The disadvantage of this system is that it the user must be supplied with a pre-modified cartridge specially-adapted for use only with the removable ink reservoirs, and in practice, this system is nearly as costly as OEM printer cartridges.

Thus, there presently exists a need for a simple method and apparatus for refilling wide format printer ink a cartridge that eliminates the problems of slow refilling, overfilling and entrapped air.

BRIEF SUMMARY OF THE INVENTION

The present invention provides semi-automated or an automated system for refilling wide format printer ink cartridges.

The system includes a computer with memory provided to store information relating to each of a plurality of wide format ink printer cartridges.

In a first aspect, the wide format fill ink cartridge refill system comprises:

a controller comprising a computer, a user interface, and ink fill operation software;

a series of ink reservoirs, each ink reservoir containing a volume of ink;

a series of ink fill needles, each needle having a tubular fill conduit having fill end and a distal end, a fill coupler provided at the fill end, a blunt tip formed at the distal end of the fill conduit, and at least one discharge aperture located through a sidewall of the fill conduit and proximate the blunt tip;

a series of ink fill stations, each station comprising a flexible tube having a needle coupler at a distal end for connection of the ink fill needle;

a series of ink pumps, each ink pump providing ink transfer from the respective ink reservoir to a respective ink fill station.

In a second aspect, the present invention overfills the wide format ink cartridge, and then removes a portion of the excess ink to ensure against any entrapped air.

In another aspect, the present invention evacuates a majority of any residual ink prior to filling the cartridge with fresh ink.

In yet another aspect, a vent needle is inserted through a vent port seal of a dual port, wide format cartridge.

While in another aspect, a colorless ink is injected into the cartridge, then a majority of the injected colorless ink is extracted to clean an interior of the ink reservoir.

In another aspect, the cartridge refill system further comprises a station housing comprising a working tray, the working tray comprising a series of apertures and positioned covering a fluid collection basin.

In yet another aspect, a series of needle holders are inserted through the apertures of the working tray.

In another aspect of the present invention, the needle comprises two (2) ink-dispensing apertures, one aperture located at 180 degrees from the other.

While, in another aspect, the needle comprises three (3) ink-dispensing apertures, each aperture located at 120 degrees from the others.

And in another aspect, the blunt tip of the needle is formed having an angle between the two edges of the tip of approximately 35 degrees.

In another aspect of the present invention, needle position is adjusted to position the needle ink dispensing aperture(s) proximate a lower edge of the fill port seal prior to an excess ink extraction step.

In another aspect, the present invention is directed to a method of filling a wide format cartridge comprises steps of:

inserting an ink fill needle into an ink port seal, the ink fill needle having a blunt tip and ink dispensing apertures on a side of the needle proximate the blunt tip;

overfilling the ink reservoir with ink;

extracting any residual air and a portion of the excess ink;

removing the ink fill needle from the wide format cartridge; and inspecting and testing the refilled cartridge to ensure quality.

In another aspect, the method further comprises the step of extracting old ink from the cartridge.

In yet another aspect, the method further comprises the step of injecting colorless ink into the cartridge to clean the reservoir of any old ink within the cartridge, then extracting the injected colorless ink.

In another aspect, a vent needle can be inserted into a vent port of a dual port cartridge form factor to allow air to pass into and from the cartridge reservoir.

In another aspect of the present invention, the method further comprises selecting a program comprising control instructions for filling a specific ink cartridge.

In another aspect of the present invention, the injecting ink step further comprises determining a required amount of ink to be added based on the model number.

In another aspect of the present invention, the method further comprises preferably overfilling the ink cartridge by approximately 5-10% depending upon the cartridge. It is understood the overfilling can actually be set anywhere from 1% on up.

In another aspect of the present invention, the method further comprises pausing for a time period between ink injection steps.

Other objects and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

BRIEF DESCRIPTION OF THE DRAWINGS

The invention will now be described, by way of example, with reference to the accompanying drawings, where like numerals denote like elements and in which.

Like reference numerals refer to like parts throughout the various views of the drawings.

DETAILED DESCRIPTION OF THE INVENTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
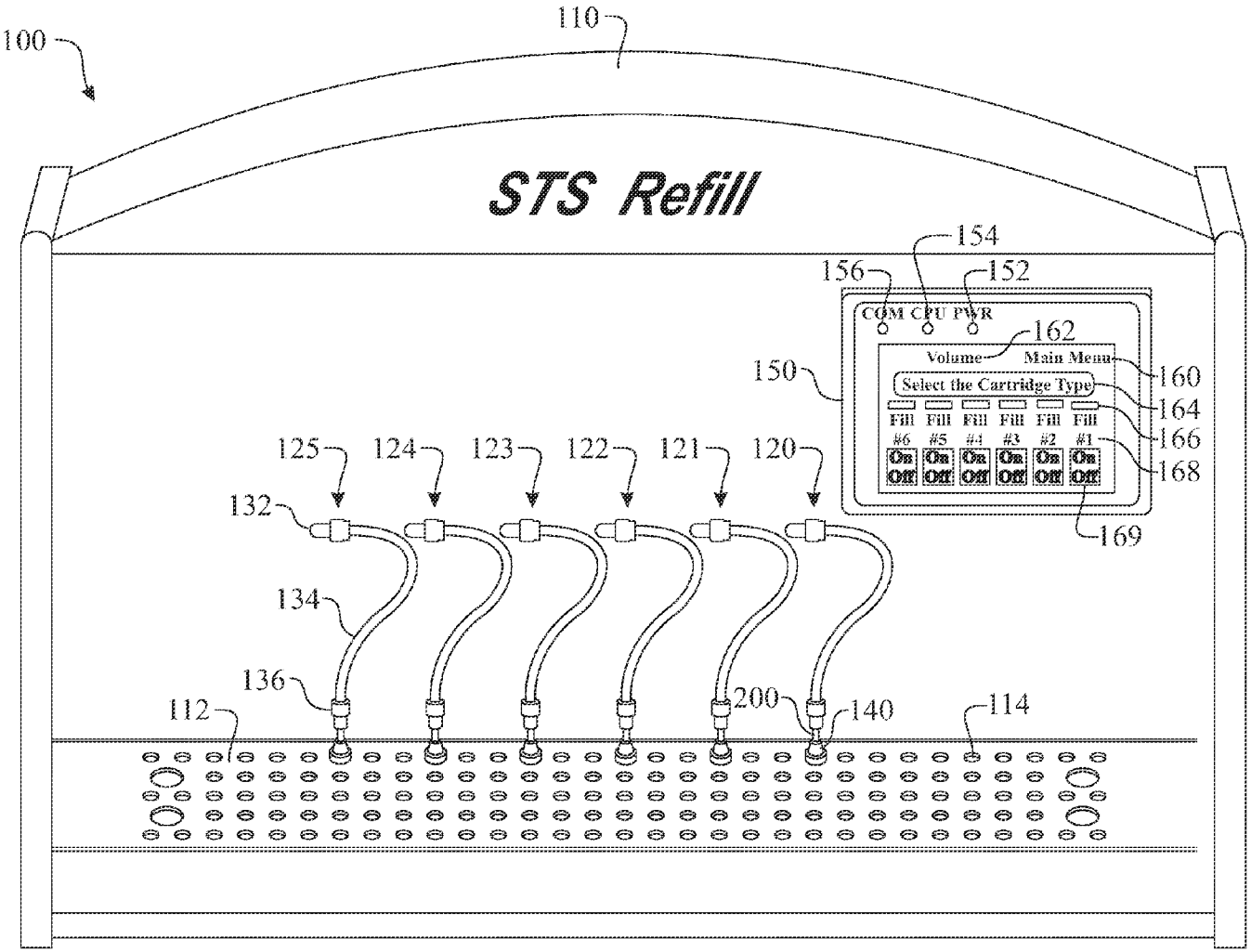
FIG. 1 presents a front elevation view of an exemplary wide format ink cartridge refilling station.

The present invention comprises a wide format cartridge refill station 100 and respective method for refilling a wide format printer ink cartridge. An exemplary wide format cartridge refill station 100 is illustrated in FIG. 1. In a preferred embodiment, the method and system for refilling the wide format printer ink cartridge utilizes a specific ink insertion needle. The system preferably comprises a positive displacement, peristaltic ink-filling pump that operates under computer control to ensure that the desired amount of ink is added to the cartridge. The desired amount includes a predetermined overfill volume, the overfill volume preferably being approximately 10% overage. As described below, an ink filling and pause cycle can be utilized during the ink injection step.

The wide format cartridge refill station 100 is preferably operated via a computer and respective software. The software (program code) elements of the present invention may be implemented with any programming or scripting language such as C, C++, C#, Java, COBOL, assembler, PERL, Unix, Linux, PLC, HMI, or the like, with the various algorithms being implemented with any combination of data structures, objects, processes, routines or other programming elements. The system preferably incorporates software modules preferably programmed in Visual C and Visual Basic. Any computer having an operating system using Microsoft Windows 95 or newer can execute the object code created.

Further, it should be noted that the present invention may employ any number of conventional techniques for data transmission, signaling, data processing, network control, and the like.

It should be appreciated that the particular implementations shown and described herein are illustrative of the invention and its best mode and are not intended to otherwise limit the scope of the present invention in any way. Indeed, for the sake of brevity, conventional data networking, and application development and other functional aspects of the systems (and components of the individual operating components of the systems) may not be described in detail herein. It should be noted that many alternative or additional functional relationships or physical or virtual connections might be present in a practical electronic data communications system.

As will be appreciated by one of ordinary skill in the art, the present invention may be embodied as a method, a data processing system, a device for data processing, and/or a computer program product. Accordingly, the present invention may take the form of an entirely software embodiment, an entirely hardware embodiment, or an embodiment combining aspects of both software and hardware. Furthermore, the present invention may take the form of a computer program product on a computer-readable storage medium having computer-readable program code means embodied in the storage medium. Any suitable computer-readable storage medium may be utilized, including hard disks, CD-ROM, optical storage devices, magnetic storage devices, and/or the like.

The present invention is described below with reference to flowchart illustrations of methods, apparatus (e.g., systems), and computer program products according to various aspects of the invention. It will be understood that each flowchart illustrations, and combinations of flowchart illustrations, respectively, can be implemented by computer program instructions. These computer program instructions may be loaded onto a general purpose computer, special purpose computer, or other programmable data processing apparatus to produce a machine, such that the instructions that execute on the computer or other programmable data processing apparatus create means for implementing the functions specified in the flowchart block or blocks.

These computer program instructions may also be stored in a computer-readable memory that can direct a computer or other programmable data processing apparatus to function in a particular manner, such that the instructions stored in the computer-readable memory produce an article of manufacture including instruction means that implement the function specified in the flowchart block or blocks. The computer program instructions may also be loaded onto a computer or other programmable data processing apparatus to cause a series of operational steps to be performed on the computer or other programmable apparatus to produce a computer-implemented process such that the instructions that execute on the computer or other programmable apparatus provide steps for implementing the functions specified in the flowchart block or blocks.

Accordingly, flowchart illustrations support combinations of means for performing the specified functions, combinations of steps for performing the specified functions, and program instruction means for performing the specified functions. It will also be understood that each functional block of the flowchart illustrations, and combinations of functional blocks in the flowchart illustrations, can be implemented by either special purpose hardware based computer systems that perform the specified functions or steps, or suitable combinations of special purpose hardware and computer instructions.

One skilled in the art will also appreciate that, for security reasons, any databases, systems, or components of the present invention may consist of any combination of databases or components at a single location or at multiple locations, wherein each database or system includes any of various suitable security features, such as firewalls, access codes, encryption, de-encryption, compression, decompression, and/or the like.

The scope of the invention should be determined by the appended claims and their legal equivalents, rather than by the examples given herein. For example, the steps recited in any method claims may be executed in any order and are not limited to the order presented in the claims. Moreover, no element is essential to the practice of the invention unless specifically described herein as "critical" or "essential."

The wide format cartridge refill station 100, as illustrated in FIG. 1 comprises a refill station housing 110. A refill station work tray 112 is provided along a lower, working region of the refill station housing 110. The refill station work tray 112 is positioned above a fluid overflow trench. A series of work tray aperture 114 are provided through the refill station work tray 112, allowing any ink to pass through into the fluid overflow trench. The wide format cartridge refill station 100 comprises a series of refill stations. The exemplary embodiment identifies the refill stations as follows:

| Ref. No. | Description |
|---|---|
| 121 | First individual refill station |
| 122 | Second individual refill station |
| 123 | Third individual refill station |
| 124 | Fourth individual refill station |
| 125 | Fifth individual refill station |
| 126 | nth individual refill station |

Figure 2:
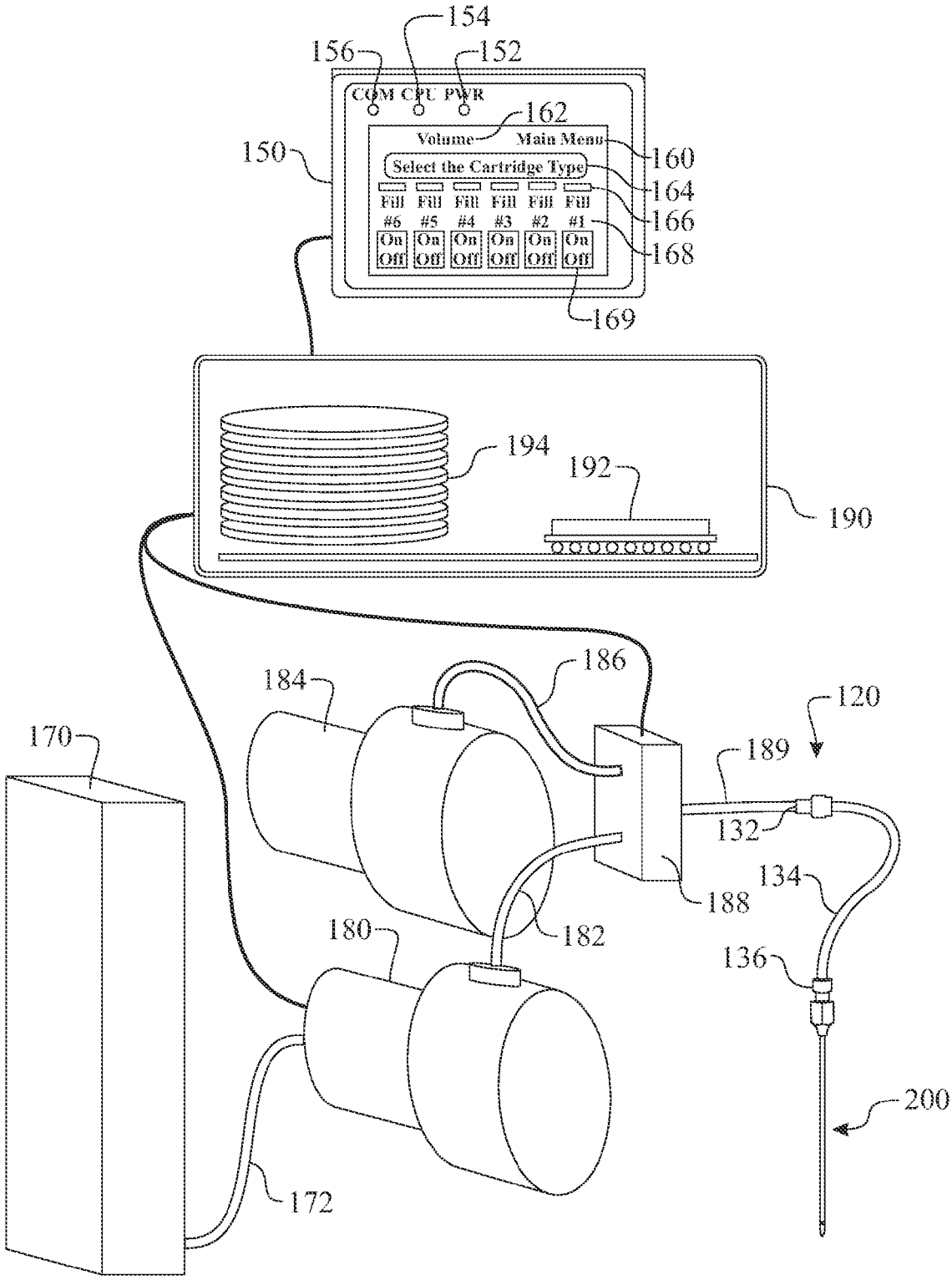
FIG. 2 presents a block diagram of an exemplary ink refill station.

Each station 120, 121, 122, 123, 124, 125 includes an ink reservoir 170, an ink source conduit 172, an ink pump 180, an ink station source conduit 182 (continuing via a valve to fill station conduit 189), a rotational ink tube connector 132, an ink fill tube 134, a fill tube needle connector 136, and an ink fill needle 200 as illustrated in FIGS. 1 and 2. It is desirable to configure each station as its own system, comprising its own ink reservoir 170, ink pump 180, needle 200, and conduits 172, 182, 189 to avoid any cross contamination.

An ink extraction system can be integrated into the system, incorporating an ink extraction pump 184 for removing any residual ink from the cartridge. The ink extraction pump 184 is in fluid communication with the rotational ink tube connector 132 via an ink station extraction conduit 186. A flow direction control valve 188 provides selectable flow control between a fill process and an extraction process. The flow direction control valve 188 directs flow from either the ink station source conduit 182 or the ink station extraction conduit 186 into the valve to fill station conduit 189. It is understood that the ink pump 180 and the ink extraction pump 184 can be the same unit; wherein the function is directed by the controller 150. The controller can fill the cartridge with a standard operation, transferring ink from the ink reservoir 170 or the controller can reverse the pump and direct the extracted ink to a discharge container.

The ink pump 180 pulls ink from the source ink reservoir 170 via the ink source conduit 172, transferring the ink to the rotational ink tube connector 132 via the ink station source conduit 182, through the flow direction control valve 188 and continuing through the valve to fill station conduit 189. An ink fill tube 134 provides fluid communication between the rotational ink tube connector 132 and the ink fill needle 200. The ink fill needle 200 (detailed in FIGS. 3 and 4) is removably coupled to the ink fill tube 134 by coupling a source connector 208 of the ink fill needle 200 to the fill tube needle connector 136. The rotational ink tube connector 132 is preferably a pivotal fixture, allowing maximum freedom of motion to the ink fill tube 134. The stations 121-126 are controlled via a station controller 150. The volume of ink transferred into the cartridge can be monitored by the known volume transfer rate of the pump 180 and time of operation of the pump 180, or by the inclusion of a meter (not shown, but well understood). A volume or flow rate meter can be integrated along the ink source conduit 172, the ink station source conduit 182 or both.

The ink extraction pump 184 can be utilized to extract any residual ink or excess ink from the cartridge. The ink extraction pump 184 is in fluid communication with the cartridge through the ink station extraction conduit 186. The ink station extraction conduit 186 is in fluid communication with the valve to fill station conduit 189 via an operable control of the flow direction control valve 188. The computer 190 would direct the flow direction control valve 188 to provide fluid communication between the ink station extraction conduit 186 and the valve to fill station conduit 189. The ink extraction pump 184 would then begin extracting the desired volume of fluid in accordance with the programmed instructions for an ink fill operation software. The extracted ink is collected in a spent ink container (not shown, but well understood). It is understood the can utilize a single ink extraction pump 184, which is connected to a plurality of fill stations, as any residual ink remaining within the ink station extraction conduit 186 will not impact the fill process.

The station controller 150 includes a computer 190 comprising a microprocessor 192 and a data storage media 194, a user interface such as a touch screen, operational software, and a cartridge fill database. The software and database can be stored within the data storage media 194. The database maintains a plurality of records associated with a type of printer and the print cartridge used in that printer. Moreover, a user is able to input cartridge identifying information to facilitate the refill process using computer ink cartridge refilling system. In a further embodiment of the present invention, the cartridge identifying information can be the model number of the ink cartridge to be refilled. Alternatively, the user can manually enter the cartridge type and ink volume.

The exemplary station controller 150 utilizes a touch screen display as a user interface. The station controller 150 can include a series of indicator LED's, such as a power indicator 152, a processor indicator 154, and a communications indicator 156. The user can contact a main menu button 160 and scroll to an operational control menu (illustrated). The user selects a cartridge selection button 164 to enter the specific cartridge being refilled. The volume is presented to the user via a cartridge volume indicator 162. The operator selects the ink color by selecting the respective fill station referenced by a station reference 168. The operator positions the respective ink fill needle 200 into the cartridge and selects a respective activation button 169. The controller then completes the ink refilling processes in accordance with the preprogrammed data respective to the selected ink cartridge. A fill status indicator 166 can convey the fill status to the operator. The data can include the overfill volume of ink, the desired target volume of ink, the color, any specific cartridge filling steps, and the like. The specific cartridge filling steps can include directions for a series of fill/pause steps as desired.

Some additional features include the use of color-coded pumps 180, color-coded conduits 172, 182, 134, and color coded ink reservoirs 170 to aid in referencing the ink colors. It is desirable to utilize a quick disconnect interface between the source ink reservoir 170 and the ink source conduit 172. It is desirable to include a colorless ink cartridge 170 for use in cleaning pre-used ink cartridges.

A series of needle receiving element 140 can be inserted through any of the work tray aperture 114 for receiving an ink fill needle 200. Any dripped ink is collected in the fluid collection basin. This maintains a clean working environment for the wide format cartridge refill station 100.

Figure 3:
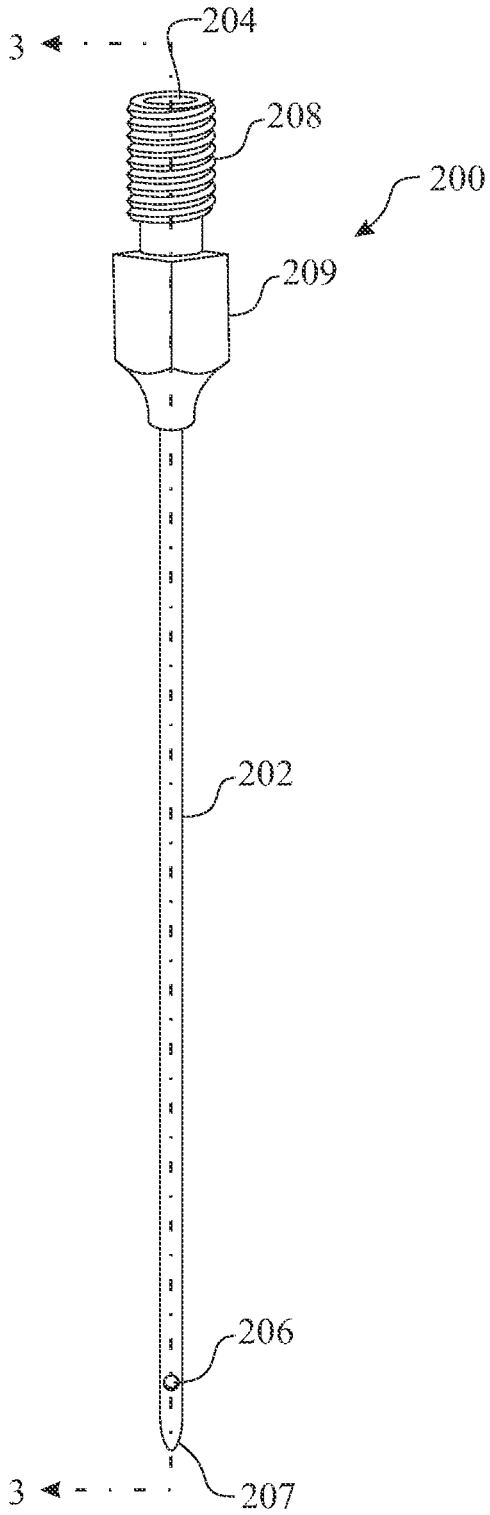
FIG. 3 presents an side elevation view of an exemplary wide cartridge fill needle.
Figure 4:
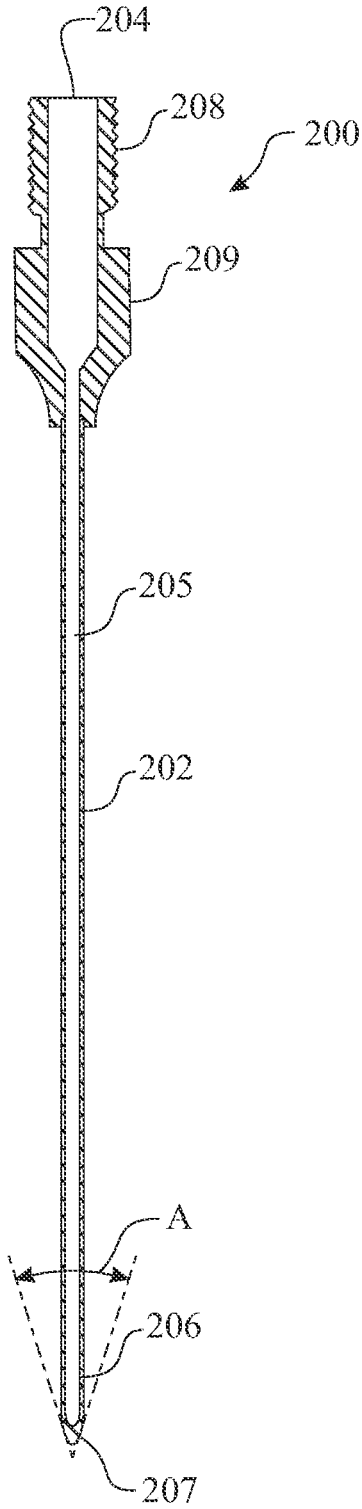
FIG. 4 presents a cross-sectional view of the wide cartridge fill needle of FIG. 2 taken along section line 4-4.

The wide format ink cartridges generally comprise a rubber or nylon ink seal providing a sealing passageway for the ink to transfer into and from a soft-sided ink reservoir. It was recognized that the current processes were not conducive to filling the wide format ink cartridges. An ink fill needle 200, as illustrated in FIGS. 3 and 4, was developed to specifically respond to the unique format of the wide format ink cartridges. The ink fill needle 200 is formed having a tubular needle conduit 202 extending from a source connector 208. A needle passage 205 is provided within the needle conduit 202, having a needle passage entrance 204 proximate a supply end and being sealed at a needle tip 207. At least one needle discharge aperture 206 is provided along a sidewall of the needle conduit 202 proximate a transition point between the sidewall and the needle tip 207. The ink fill needle 200 can include a single needle discharge aperture 206, a pair of needle discharge apertures 206 positioned at 180 degrees from each other, three needle discharge apertures 206 positioned at 120 degrees from each other, and the like. A connector grip 209 can be integrated into the ink fill needle 200 proximate the source connector 208, wherein the connector grip 209 provides the user with a region for engaging a tool to aid in securing the source connector 208 with the fill tube needle connector 136. The ink fill needle 200 is preferably shaped in a linear form factor.

The ink fill needle 200 can be described as an extraction needle, wherein the same design is utilized for two separate functions. The needle conduit 202 can provide a conduit for filling ink or extracting ink from the cartridge and referred to as a fill conduit or an extraction conduit. The needle discharge aperture 206 can be used for discharging ink or referred to as an extraction aperture for removal of ink. The needle passage entrance 204 can be referred to as a vacuum end of the ink fill needle 200.

Two key factors in the needle design contribute to perfecting the refilling process of the wide format cartridges. The needle discharge aperture 206 is a blunt design having an angle referenced as "A" of approximately 35 degrees. The needle discharge apertures 206 are positioned through the sidewall discharging the ink in a direction that is perpendicular to the needle conduit 202. The blunt design of the needle discharge aperture 206 ensures against damaging or puncturing a soft-sided ink reservoir of the wide format cartridge. Positioning the needle discharge aperture 206 avoids any removal of material from the port seal 306 (FIG. 5), which is critical to ensure the seal avoids any leaks.

Figure 5:
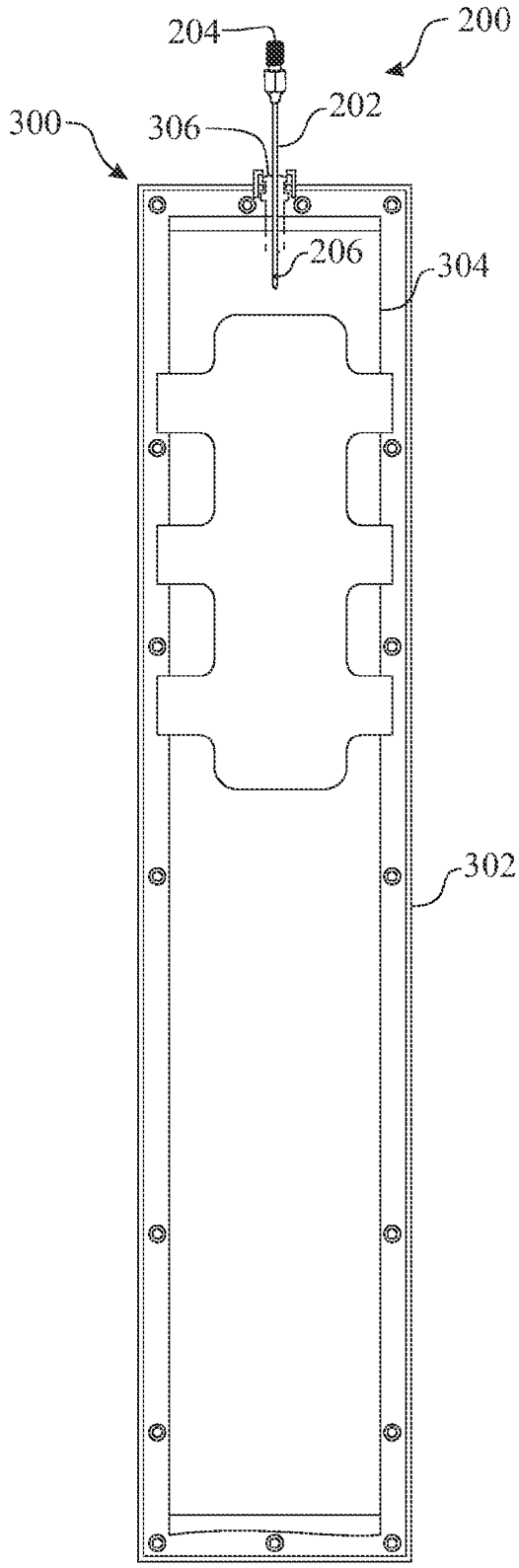
FIG. 5 presents a cross-sectional view illustrating an interior and respective operative components of a single port wide format ink cartridge incorporating a fill needle inserted therein.
Figure 6:
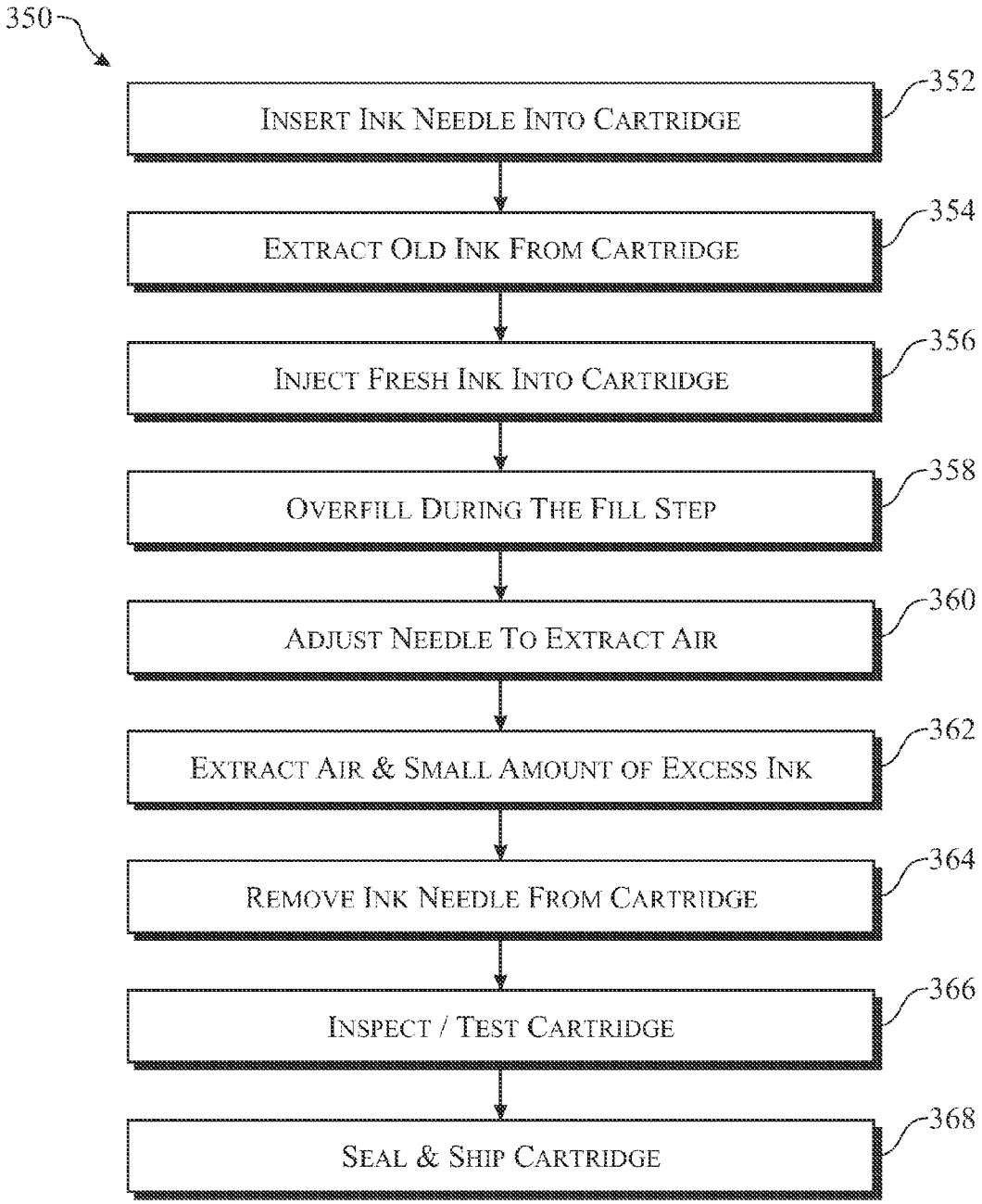
FIG. 6 presents an exemplary flow diagram detailing a method for filling a single port wide format ink cartridge.
Figure 7:
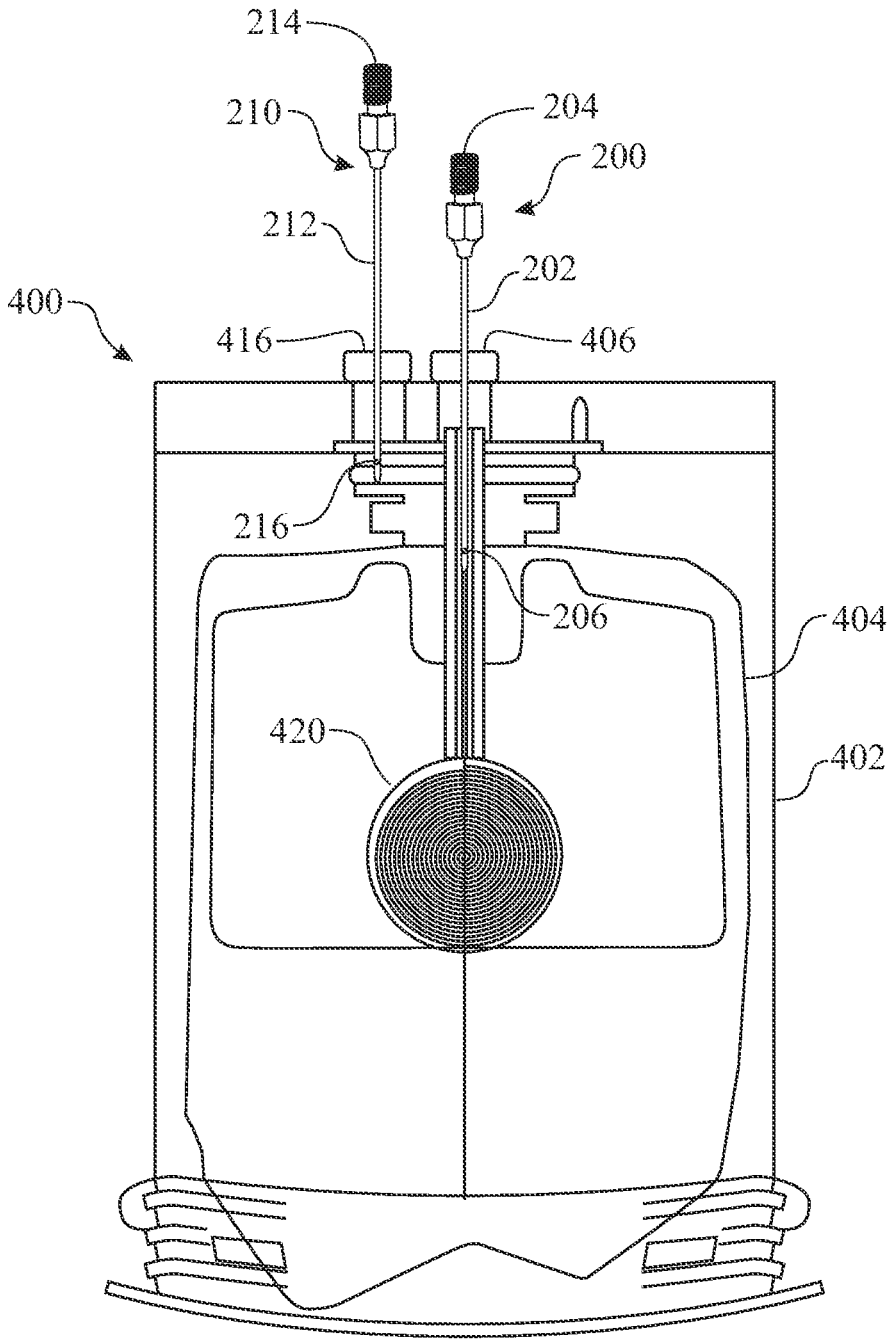
FIG. 7 presents a cross-sectional view illustrating an interior and respective operative components of a dual port wide format ink cartridge incorporating a fill needle and a vent needle inserted therein.

The wide format cartridges are sold in several form factors. The disclosure details a single port wide format cartridge 300, as illustrated in FIG. 5 and a dual port wide format cartridge 400, as illustrated in FIG. 7. The single port wide format cartridge 300 is filled in accordance with a fill process detailed in the single port ink refill flow process 350 presented in FIG. 6. The single port wide format cartridge 300 includes an ink reservoir 304 positioned within a wide format enclosure 302. An ink port seal 306 is a self-sealing port providing fluid communication between the ink reservoir 304 and a printer ink system (not shown, but well understood by application). The operator inserts the ink fill needle 200 into the single port wide format cartridge 300 through the ink port seal 306 in accordance with an ink needle insertion step 352. A vacuum is applied to the ink fill station to extract any residual ink from the spent cartridge 300, as referred to as a residual ink extraction step 354. The operator then initiates a fill step 356, injecting fresh ink into the single port wide format cartridge 300. The computer 190 operates the ink fill pump 180 monitoring the volume of ink transferred to the single port wide format cartridge 300. The computer 190 overfills the ink reservoir 304 in accordance with an overfill step 356. The ink reservoir 304 is generally overfilled by 5 to 10%. It is understood the overfilling can actually be set anywhere from 1% on up. Once filled, the operator can optionally adjust the needle position 360 to extract any trapped air within the ink reservoir 304. The system converts to a vacuum and removes any entrapped air and a portion of the excess ink, in accordance with an entrapped air and excess ink extraction step 362. Alternately, the system can utilize the excess pressure provided within the ink reservoir 304 to "burp" the air and excess ink by opening a vent valve placed in line. The vent valve can be integrated into the flow direction control valve 188. The flow direction control valve 188 can be a solenoid valve. The system automatically stops following removal of a small volume of ink, leaving the cartridge with a volume of ink, and very minimal (if any) entrapped air. The operator then removes the ink fill needle 200 from the ink port seal 306 per an ink needle removal step 364. The single port wide format cartridge 300 is inspected and tested 366 by inserting the refilled single port wide format cartridge 300 into a test station to ensure the refilled single port wide format cartridge 300 meets the minimum quality standards. If the refilled single port wide format cartridge 300 passes the inspection and testing, the single port wide format cartridge 300 is subjected to a sealing, packaging, and shipping step 368.

Figure 8:
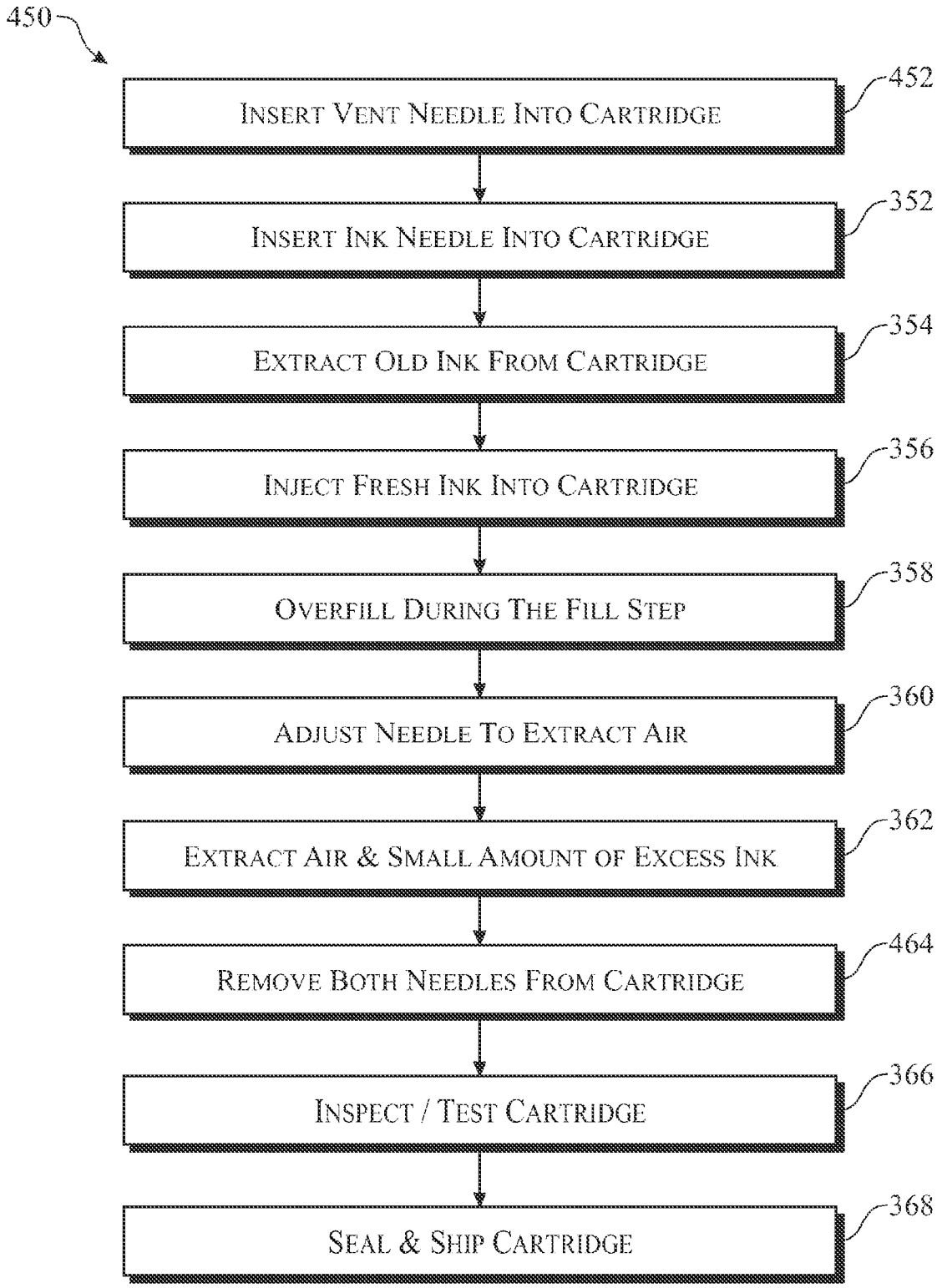
FIG. 8 presents an exemplary flow diagram detailing a method for filling a dual port wide format ink cartridge.

A dual port wide format cartridge 400 comprises a more complex fill system, as illustrated in FIG. 7. The dual port wide format cartridge 400 is filled in accordance with a fill process detailed in the dual port ink refill flow process 450 presented in FIG. 8. The dual port wide format cartridge 400 includes an ink reservoir 404 positioned within a wide format enclosure 402. An ink port seal 406 is a self-sealing port providing fluid communication between the ink reservoir 404 and a printer ink system (not shown, but well understood by application). A vent port seal 416 is integrated into the dual port wide format cartridge 400, the vent port seal 416 providing an airflow passage between the ink reservoir 404 and atmosphere. An optional volume indicator 420 can be integrated into either wide format cartridge 300, 400. The operator inserts a vent needle 210, wherein the vent needle 210 is similar to an ink fill needle 200 used for venting, into the dual port wide format cartridge 400 through the vent port seal 416 in accordance with a vent needle insertion step 452. The vent needle 210 comprises a needle conduit 212 providing fluid communication between a needle vent aperture 216 and a needle vent exit 214. The operator inserts the ink fill needle 200 into the dual port wide format cartridge 400 through the ink port seal 406 in accordance with an ink needle insertion step 352. The dual port ink refill flow process 450 continues in accordance with steps referenced as 354 through 368 as previously described in the single port ink refill flow process 350. The needle removal step 464 directs the operator to remove both the ink fill needle 200 and vent needle 210 from the respective ports.

Figure 9:
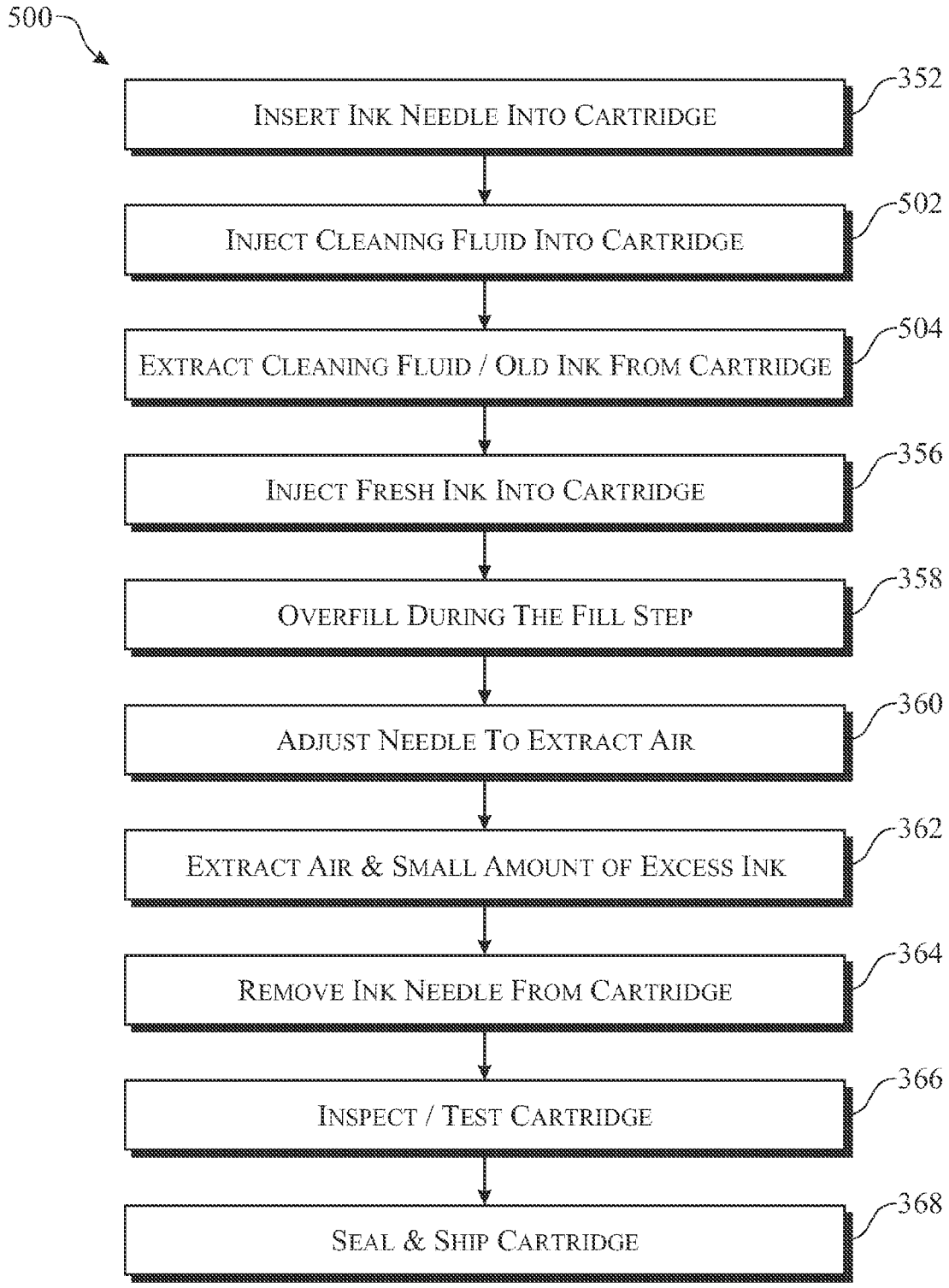
FIG. 9 presents an exemplary flow diagram detailing a method for cleaning and filling a wide format ink cartridge.

At times, an operator may desire to change the ink color or quality from the original color or quality to a new color or quality. This can be accomplished by adding a series of reservoir cleaning steps to the single port ink refill flow process 350, as illustrated in a refill and precleaning process 500 of FIG. 9. The system injects a cleaning fluid into the cartridge 300, 400, in accordance with a cleaning fluid injection step 502. The cleaning fluid is generally a colorless ink mixture, having the same general chemistry as the refilling ink. The operator can optionally shake the filled cartridge, subject to a vibrator source, and the like to aid in mixing any residual ink with the cleaning fluid. The system advances by extracting the cleaning fluid and any residual ink from the cartridge 300, 400, in accordance with a cleaning fluid extraction step 504. The refill and precleaning process 500 continues in accordance with steps referenced as 354 through 368 as previously described in the single port ink refill flow process 350. It is understood the same cleaning steps 502, 504 can also be included in the dual port ink refill flow process 450.

In accordance with the foregoing description, the present invention provides the following advantages:

The design of the needle tip 207 ensures the ink reservoir 304, 404 does not get damaged. The needle tip 207 does not damage the port seals of the wide format cartridges 300, 400. The location of the needle discharge apertures 206 provides several advantages. The ink discharges laterally, aiding in the fill process while eliminating any potential generation of air bubbles. The ink contacts the sidewalls of the ink reservoir 304, 404 and uses surface tension to continue to the balance of the ink. Contrarily, if the ink where discharged towards the volume of ink, the discharged ink would create bubbles when it contacts the volume of the ink. This can be compared to rain falling onto a body of water. The splashing introduces air into the body of water.

By using a positive displacement pump 180, computer 190 can precisely control the amount of ink that is added to the cartridge to perfect the proper refilling process. The ink fill pump 180 overfills the expandable soft-sided ink reservoirs 304, 404, displacing any entrapped air. The remaining entrapped air and a portion of the excess ink is removed via an extraction step 362 following the overfilling step 358.

It is understood the process can be applied to cartridges comprising semi-rigid sided reservoirs as well as those comprising soft-sided reservoirs 304, 404.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. A wide format printer ink cartridge refill station, the station comprising:

a controller comprising a computer, a user interface, and ink fill operation software;

at least one ink reservoir, said at least one ink reservoir containing ink;

at least one ink fill needle, said at least one ink fill needle comprising a tubular fill conduit having a source end and a distal end, a fill coupler provided at said source end, a blunt tip formed at said distal end of said fill conduit, and at least one discharge aperture located through a sidewall of said fill conduit and proximate said blunt tip;

at least one ink fill station, said at least one ink fill station comprises a flexible tube having a needle coupler disposed at a distal end for removable connection of said ink fill needle; and at least one ink pump, said at least one ink pump provides ink transfer from said respective ink reservoir to a respective ink fill station by way of an ink source conduit providing fluid communication between said respective ink reservoir and said respective ink fill pump and an ink station source conduit providing fluid communication between said ink fill pump and said respective ink fill station, an extraction pump in fluid communication with an extraction needle by way of a ink station extraction conduit, said extraction needle having a tubular extraction conduit having a source end and a distal end, a coupler provided at said vacuum end, a blunt tip formed at said distal end of said extraction conduit, and at least one aperture located through a sidewall of said extraction conduit and proximate said blunt tip;

a flow direction control valve, said flow direction control valve being integrated in fluid communication between said ink pump and said respective extraction pump and said ink fill station for selectively providing fluid communication between one of said ink pump and said extraction pump and said ink fill station;

wherein, in use, said at least one ink fill needle is attached in fluid communication with a respective ink fill station by coupling said ink fill needle with said respective needle coupler.

2. A wide format printer ink cartridge refill station as recited in claim 1, the needle comprising two discharge apertures located through said sidewall of said fill conduit and proximate said blunt tip, each aperture located at 180 degrees from the other apertures.

3. A wide format printer ink cartridge refill station as recited in claim 1, the needle comprising three discharge apertures located through said sidewall of said fill conduit and proximate said blunt tip, each aperture located at 120 degrees from the other apertures.

4. A wide format printer ink cartridge refill station as recited in claim 1, the station further comprising a vent needle, said vent needle comprising a tubular conduit having a vent end and a distal end, a blunt tip formed at said distal end of said tubular conduit, and at least one vent aperture located through a sidewall of said tubular conduit and proximate said blunt tip, wherein said vent needle is inserted into a vent port seal of a dual port wide format cartridge wherein, in use, said vent needle enables venting of air from a cartridge ink reservoir during an ink filling step.

5. A method of filling a wide format printer ink cartridge, the method comprising steps of:

obtaining a wide format ink cartridge for refilling, said wide format ink cartridge comprising an ink reservoir having a container volume and an ink port seal in communication with said container volume;

inserting an ink fill needle into a port seal of said wide format ink cartridge, said ink fill needle comprising a tubular fill conduit having a source end and a distal end, a fill coupler provided at said source end, a blunt tip formed at said distal end of said fill conduit, and at least one discharge aperture located through a sidewall of said fill conduit and proximate said blunt tip;

injecting said selected ink into said ink reservoir through said ink fill needle;

monitoring an injected volume of ink;

overfilling said ink reservoir; and removing said ink fill needle from said port seal.

6. A method of filling a wide format printer ink cartridge as recited in claim 5, the method further comprising a step of:

extracting a portion of said excess ink inserted into said ink reservoir during said overfilling step.

7. A method of filling a wide format printer ink cartridge as recited in claim 6, said wide format ink cartridge further comprising a vent port seal in communication with said container volume;

the method further comprising a step of:

inserting a vent needle into said vent port seal.

8. A method of filling a wide format printer ink cartridge as recited in claim 5, said wide format ink cartridge further comprising a vent port seal in communication with said container volume;

the method further comprising a step of:

inserting a vent needle into said vent port seal.

9. A method of filling a wide format printer ink cartridge as recited in claim 8, the method further comprising a step of:

injecting a cleaning fluid into said ink reservoir; and extracting a majority of said cleaning fluid and residual ink from said ink reservoir prior to filling said ink reservoir with said selected ink.

10. A method of filling a wide format printer ink cartridge as recited in claim 5, the method further comprising steps of:

injecting a cleaning fluid into said ink reservoir; and extracting a majority of said cleaning fluid and residual ink from said ink reservoir prior to filling said ink reservoir with said selected ink.

11. A method of filling a wide format printer ink cartridge as recited in claim 5, the method further comprising a step of:

testing said refilled wide format printer ink cartridge.

12. A method of filling a wide format printer ink cartridge as recited in claim 5, the method further comprising a step of:

obtaining said container volume of said wide format ink cartridge from an ink cartridge information database.

13. A method of filling a wide format printer ink cartridge, the method comprising steps of:

obtaining a wide format ink cartridge for refilling, said wide format ink cartridge comprising an ink reservoir having a container volume and an ink port seal in communication with said container volume;

inserting an ink fill needle into a port seal of said wide format ink cartridge, said ink fill needle comprising a tubular fill conduit having a source end and a distal end, a fill coupler provided at said source end, a blunt tip formed at said distal end of said fill conduit, and at least one discharge aperture located through a sidewall of said fill conduit and proximate said blunt tip;

injecting said selected ink into said ink reservoir through said ink fill needle;

monitoring an injected volume of ink;

overfilling said ink reservoir;

removing said ink fill needle from said port seal;

extracting at least a portion of said excess ink inserted into said ink reservoir during said overfilling step; and testing said refilled wide format printer ink cartridge.

14. A method of filling a wide format printer ink cartridge as recited in claim 13, said wide format ink cartridge further comprising a vent port seal in communication with said container volume;

the method further comprising a step of:

inserting a vent needle into said vent port seal.

15. A method of filling a wide format printer ink cartridge as recited in claim 14, the method further comprising steps of:

injecting a cleaning fluid into said ink reservoir; and extracting a majority of said cleaning fluid and residual ink from said ink reservoir prior to filling said ink reservoir with said selected ink.

16. A method of filling a wide format printer ink cartridge as recited in claim 13, the method further comprising steps of:

injecting a cleaning fluid into said ink reservoir; and extracting a majority of said cleaning fluid and residual ink from said ink reservoir prior to filling said ink reservoir with said selected ink.

17. A method of filling a wide format printer ink cartridge as recited in claim 13, the method further comprising a step of:

obtaining said container volume of said wide format ink cartridge from an ink cartridge information database.

18. A method of filling a wide format printer ink cartridge as recited in claim 13, wherein said step of extracting at least a portion of said excess ink inserted into said ink reservoir during said overfilling step is completed by releasing said pressure generated within said ink reservoir to cause said excess ink to discharge through said fill needle.

* * * * *